US008901446B2

(12) United States Patent
Fong et al.

(10) Patent No.: US 8,901,446 B2
(45) Date of Patent: Dec. 2, 2014

(54) LIMIT STOP APPARATUS, CIRCUIT BREAKERS INCLUDING LIMIT STOPS, AND METHODS OF USING SAME

(75) Inventors: Sheenfar Sean Fong, Lawrenceville, GA (US); Francisco Cesar Margain Perez, San Pedro Garza Garcia (NL)

(73) Assignee: Siemens Aktiengesellschaft, München (DE)

( * ) Notice: Subject to any disclaimer, the term of this patent is extended or adjusted under 35 U.S.C. 154(b) by 277 days.

(21) Appl. No.: 13/368,450

(22) Filed: Feb. 8, 2012

(65) Prior Publication Data

US 2012/0199449 A1 Aug. 9, 2012

(30) Foreign Application Priority Data

Feb. 8, 2011 (WO) ..... PCT/US2011/024016

(51) Int. Cl.
*H01H 1/22* (2006.01)
*H01H 9/34* (2006.01)

(52) U.S. Cl.
CPC ..... *H01H 1/226* (2013.01); *H01H 9/345* (2013.01)
USPC ..... 218/26; 315/16; 315/115; 315/202

(58) Field of Classification Search
USPC ..... 218/26, 154; 335/115, 16, 102
See application file for complete search history.

(56) References Cited

U.S. PATENT DOCUMENTS 3,132,225 A 5/1964 Swinehart
3,133,164 A 5/1964 Dennison
3,243,558 A 3/1966 Link
4,061,896 A 12/1977 Clancy
5,025,236 A * 6/1991 Miura et al. ..... 335/46
5,027,096 A * 6/1991 White et al. ..... 335/202
5,389,906 A * 2/1995 Castonguay et al. ..... 335/172
5,844,455 A * 12/1998 Song ..... 335/16
5,899,323 A 5/1999 Rakus
5,926,081 A * 7/1999 DiMarco et al. ..... 335/16

(Continued)

FOREIGN PATENT DOCUMENTS

DE 10222011 C1 11/2003
EP 0008989 A1 3/1980
EP 1858041 A2 11/2007
WO WO 2011097612 A1 8/2011

OTHER PUBLICATIONS

PCT Invitation to Pay Additional Fees mailed May 15, 2012 corresponding to PCT International Application No. PCT/US2012/024269 filed Feb. 8, 2012.

(Continued)

*Primary Examiner* — Truc Nguyen

(57) ABSTRACT

A limit stop apparatus for a multi-pole electrical contact assembly is disclosed. The limit stop apparatus interconnects crossbars of respective contact assemblies wherein one or more contact arms are pivotable relative to each crossbar. The limit stop apparatus is configured to engage the one or more contact arms on a same side of the one or more contact arms containing moveable electrical contacts. In one or more embodiments, the limit stop apparatus has a connecting bar with limit stops having arc shields molded to the connecting bar, wherein the arc shields can be phase-to-phase arc shields and contact-to-component arc shields. Circuit breakers and multi-pole electrical contact assemblies having a limit stop apparatus, and methods of operating the multi-pole electrical contact assembly are disclosed, as are other aspects.

20 Claims, 11 Drawing Sheets

(56) References Cited

U.S. PATENT DOCUMENTS

| | | | | |
|---|---|---|---|---|
| 5,933,066 | A * | 8/1999 | Chontas et al. | 335/202 |
| 6,255,926 | B1 * | 7/2001 | Gundy et al. | 335/202 |
| 6,376,788 | B1 * | 4/2002 | Jones et al. | 200/244 |
| 6,512,192 | B1 * | 1/2003 | Yee et al. | 218/157 |
| 6,791,440 | B2 * | 9/2004 | Harmon et al. | 335/16 |
| 7,148,775 | B2 * | 12/2006 | Park | 335/16 |
| 7,391,597 | B2 * | 6/2008 | Meeks et al. | 361/115 |
| 2010/0270268 | A1 * | 10/2010 | Gericke et al. | 218/154 |

OTHER PUBLICATIONS

PCT International Search Report mailed Sep. 28, 2012 corresponding to PCT International Application No. PCT/US2012/024269 filed Feb. 8, 2012 (15 pages).

* cited by examiner

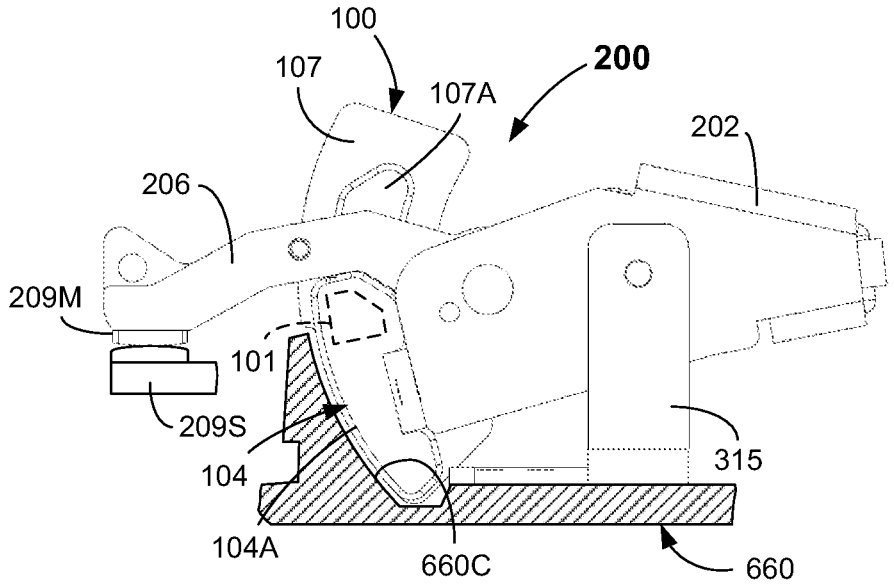
FIG. 6A ON
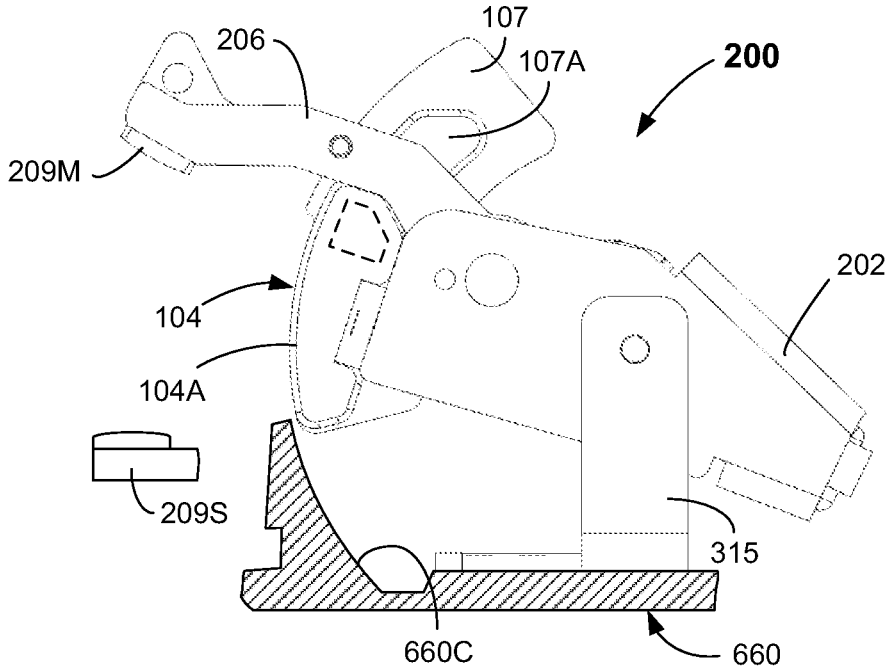
FIG. 6B OFF

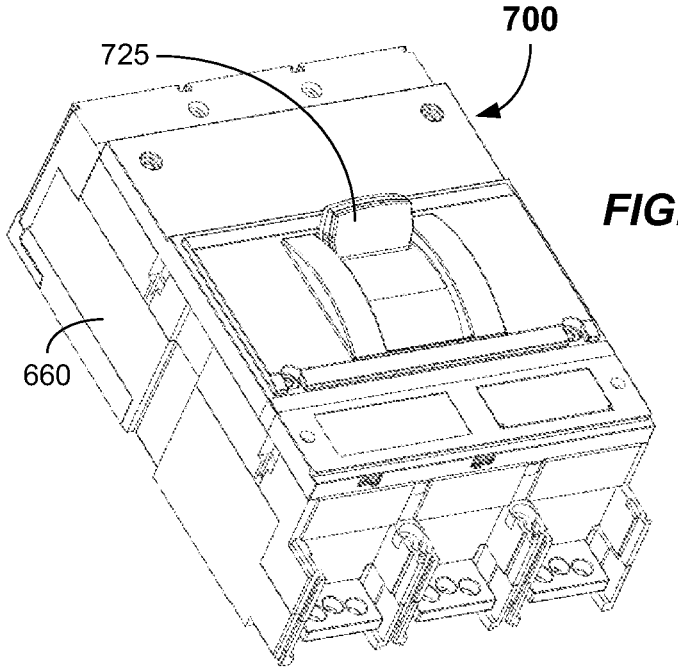
FIG. 7
FIG. 8
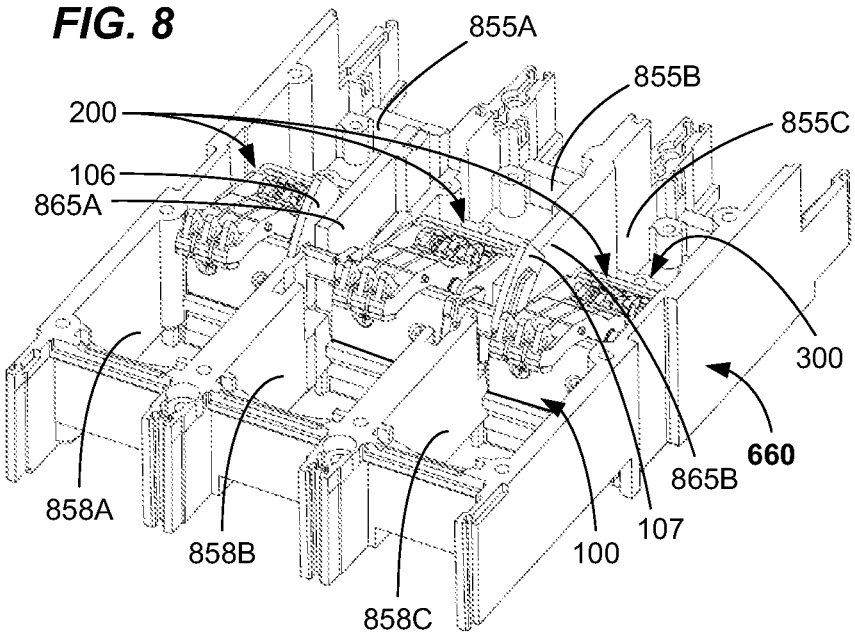

LIMIT STOP APPARATUS, CIRCUIT BREAKERS INCLUDING LIMIT STOPS, AND METHODS OF USING SAME

RELATED APPLICATIONS

This application claims priority to PCT Application Serial Number PCT/US2011/024016 filed on Feb. 8, 2011, entitled "CIRCUIT BREAKER ELECTRICAL CONTACT ASSEMBLY, AND SYSTEMS AND METHODS USING SAME" the disclosure of which is hereby incorporated by reference in its entirety herein.

FIELD

The present invention relates generally to circuit breakers, and more particularly to apparatus adapted to limit rotation of components used in circuit breakers.

BACKGROUND

Within circuit breakers, one or moveable electrical contacts may be provided. Typically, such moveable electrical contacts are included on moveable contact arms that pivot relative to a circuit breaker housing. Generally, a spring biases the moveable contact to a closed configuration such that intimate contact is provided between a stationary and moveable electrical contact. Some circuit breakers may include multiple interconnected contact assemblies. For example, a single electrical phase may be directed and coupled to individual side-by-side electrical contact assemblies of a multi-phase circuit breaker. Three or four phase breaker assemblies are commonplace. Each electrical contact assembly may be connected to adjacent ones through a cross member, and each of the side-by-side electrical contact assemblies is adapted to pivot about a common pivot axis.

However, existing pivoting constructions may lead to certain design compromises. Thus, improved pivoting apparatus adapted to use in side-by-side electrical contact assemblies are sought.

SUMMARY

In a first embodiment, a limit stop apparatus is provided. The limit stop apparatus includes a connecting bar, and arc shields molded to the connecting bar, the arc shields comprising phase-to-phase arc shields and contact-to-component arc shields.

In a system embodiment, a multi-pole electrical contact assembly is provided. The multi-pole electrical contact assembly includes a plurality of electrical contact assemblies, each electrical contact assembly having a crossbar and one or more contact arms pivotable relative to the crossbar, and a limit stop apparatus coupled to the crossbar of each electrical contact assembly, wherein the limit stop apparatus has limit stops configured and adapted to engage the one or more contact arms on a same side of the one or more contact arms containing moveable electrical contacts.

In another apparatus embodiment, a circuit, breaker is provided. The circuit breaker includes a circuit breaker housing, a plurality of electrical contact assemblies, each electrical contact assembly having a crossbar and one or more contact arms moveable relative to the crossbar, and a limit stop apparatus coupled to the crossbars of each of the plurality of electrical contact assemblies, wherein the limit stop apparatus has limit stops configured and adapted to engage the one or more contact arms on a same side of the one or more contact arms containing moveable electrical contacts.

In a method aspect, a method of operating a multi-pole electrical contact assembly is provided. The method includes providing a plurality of electrical contact assemblies, each electrical contact assembly having a crossbar and one or more contact arms having one or more moveable electrical contacts pivotable relative to the crossbar, and a limit stop apparatus having limit stops, the limit stop apparatus coupled to and interconnecting to the crossbar of each electrical contact assembly, and engaging with the limit stop apparatus, the one or more contact arms on a same side of the one or more contact arms containing the one or more moveable electrical contacts.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the spirit and scope of the present invention. Accordingly, the drawings and descriptions are to be regarded as illustrative in nature, and not as restrictive. The invention is to cover all modifications, equivalents, and alternatives falling within the scope of the invention.

BRIEF DESCRIPTION OF DRAWINGS

FIG. 6A illustrates a partially cross-sectioned side view of an electrical contact assembly shown in a closed (ON) configuration according to embodiments.

FIG. 6B illustrates a partially cross-sectioned side view of an electrical contact assembly shown in an open (OFF) configuration according to embodiments.

FIG. 7 shows an isometric view of a circuit breaker including that may include a multi-pole electrical contact assembly according to embodiments.

FIG. 8 shows an isometric view of a circuit breaker housing with an upper housing portion removed including a multi-pole electrical contact assembly according to embodiments.

DESCRIPTION

In view of the foregoing difficulties, an improved limit stop apparatus is provided, as well as an electrical contact assembly including the limit stop apparatus. In another aspect, a circuit breaker including the improved limit stop apparatus and multi-pole electrical contact assembly is provided. Methods of operating a multi-pole electrical contact assembly including the limit stop apparatus are also provided.

As will become apparent from the various embodiments, the limit stop apparatus has limit stops that advantageously limit motion of the one or more contact arms of the individual contact assemblies. The limit stop functions to tie the individual electrical contact assemblies together such that the crossbars thereof move in unison, such as when a circuit breaker handle is actuated. Furthermore, the limit stop apparatus may include arc shields that function to limit exposure of the internal contact assembly components to arcing and arc debris upon encountering an interruption event (e.g., after breaker tripping).

These and other embodiments of the limit stop apparatus, multi-pole electrical contact assembly, circuit breakers including a multi-pole electrical contact assembly and methods of operating multi-pole electrical contact assemblies are described below with reference to FIGS. 1A-1B. The drawings are not necessarily drawn to scale. Like numerals are used throughout to denote like elements.

Figure 1A:
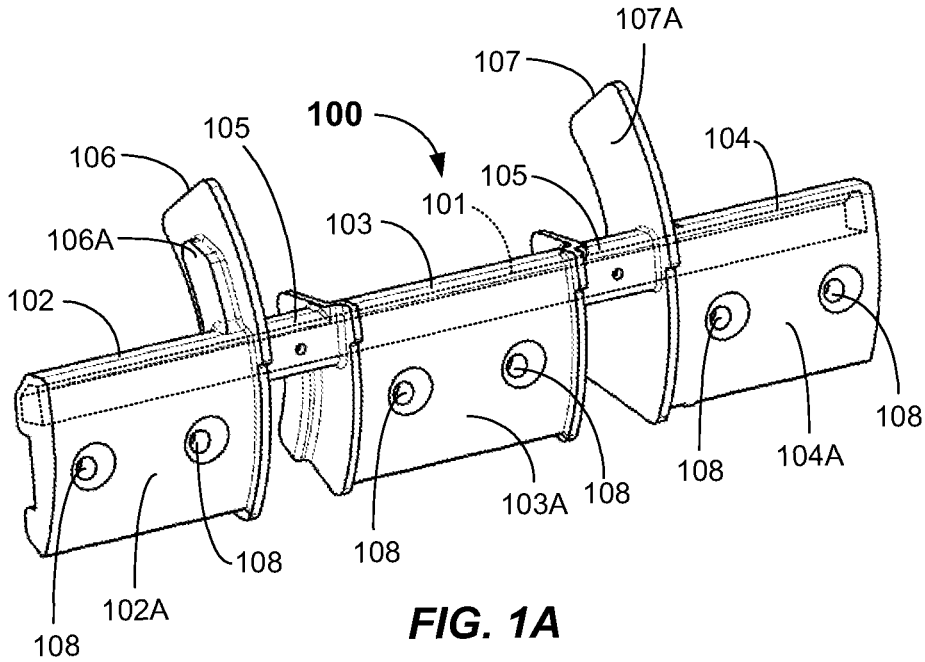
FIG. 1A illustrates a front isometric view of a limit stop apparatus adapted to mount to a plurality of electrical contact assemblies according to embodiments.
Figure 1B:
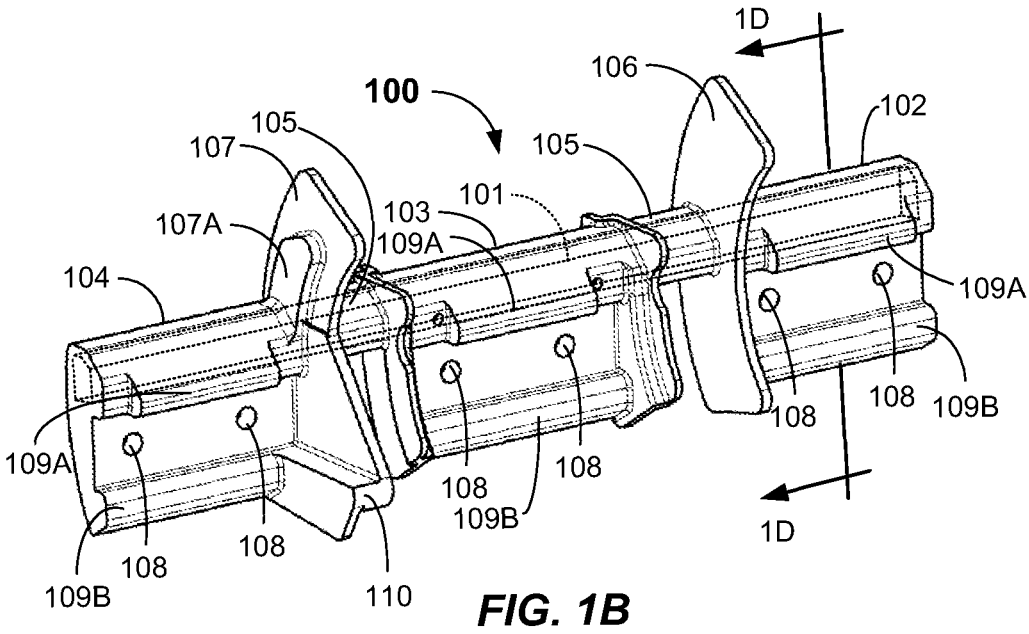
FIG. 1B illustrates a rear isometric view of the limit stop apparatus according to embodiments.

Referring now in specific detail to FIGS. 1A-1B, a limit stop apparatus 100 is shown. The limit stop apparatus 100 is a part of a multi-pole contact assembly 300 (FIG. 3) that may be installed in a circuit breaker housing 660 of a circuit breaker 700, as shown in FIGS. 7-10, for example. The limit stop apparatus 100 may perform multiple functions within the circuit breaker 700, and is functionally coupled to, and interconnects, individual contact assemblies 200 (FIG. 2) with one another. In order to understand the function of the limit stop apparatus 100, the electrical contact assembly 200 will first be described.

Referring now in specific detail to FIG. 2 to FIG. 5B, an embodiment of the electrical contact assembly 200 and its components are shown. The electrical contact assembly 200 will be referred to herein as an "electrical contact assembly," "contact assembly," or just "assembly." The contact assembly 200 may be installed in a circuit breaker housing 660 of a circuit breaker 700, as shown in FIGS. 6A-10, for example. As depicted, the circuit breaker 700 may include multiple individual contact assemblies 200 (e.g., one for each electrical phase). For example, a multi-pole contact assembly 300 may be included in a three-pole circuit breaker (See FIGS. 3 and 8) and may include three electrical contact assemblies 200 oriented in a side-by side configuration.

Figure 4A:
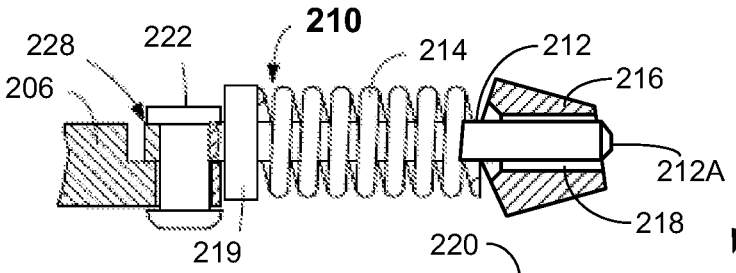
FIGS. 4A and 4B illustrates partially cross-sectioned partial side views of various spring assemblies that may be used in an electrical contact assembly according to embodiments.
Figure 4B:
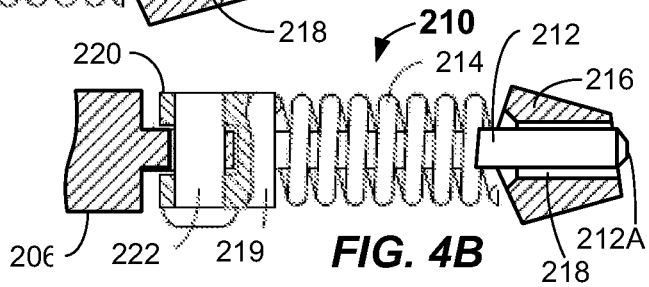
Figure 5A:
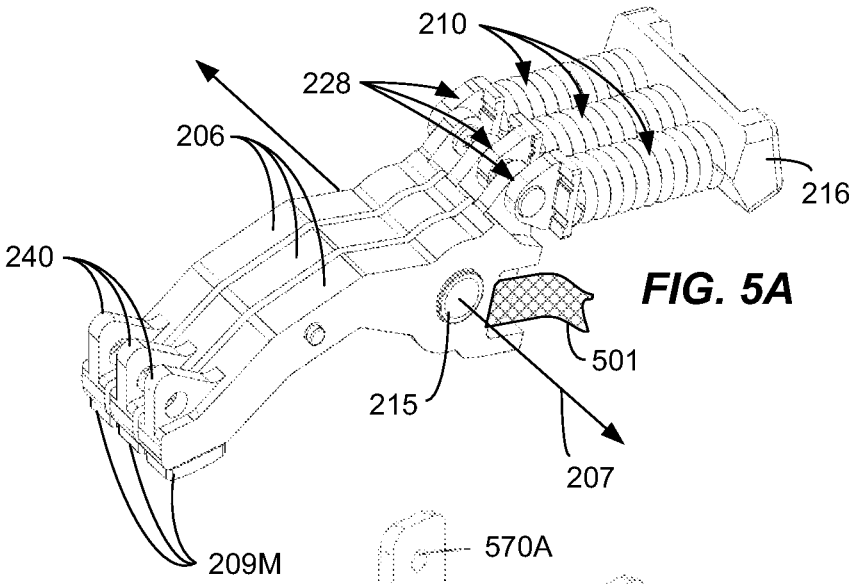
FIG. 5A illustrates an isometric view of spring assemblies mounted between contact arms and a common crossbar insert of an electrical contact assembly according to embodiments.

Again referring to FIGS. 2-5B, each electrical contact assembly 200 may be interconnected to a respective load terminal (e.g., a single phase) via one or more flexible electrical conductors 501 (FIG. 5A). In some embodiments, the flexible electrical conductor 501 may be one or more braided or laminated conductive metal lines. The flexible electrical conductor 501 may be connected to each of the contact arms 206 (described below), such as by braising, welding, soldering, or the like. Other means for connection may be employed. The contact assembly 200 may include one or more contact arms 206.

Figure 2:
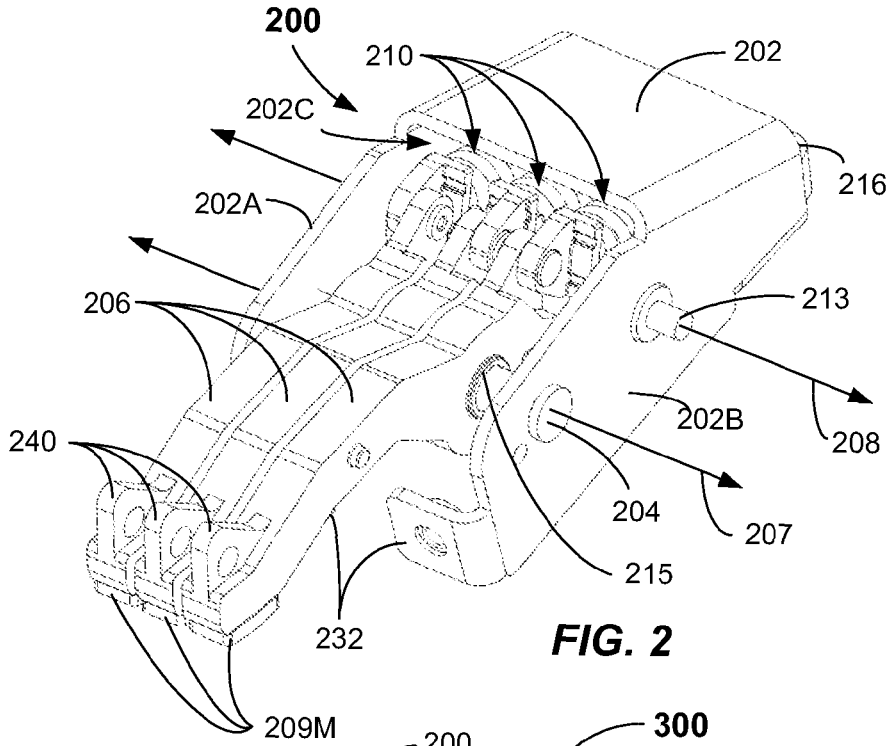
FIG. 2 illustrates an isometric view of an electrical contact assembly according to embodiments.
Figure 3:
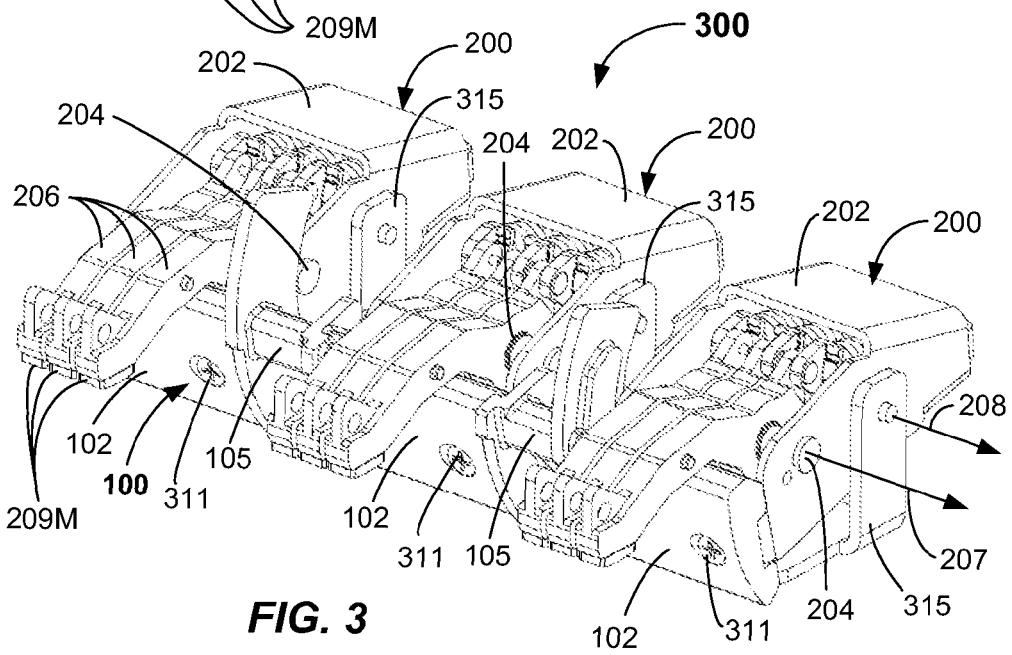
FIG. 3 illustrates an isometric view of a multi-pole contact assembly including a plurality of electrical contact assemblies of FIG. 2 interconnected by the limit stop apparatus of FIG. 1A-1B according to embodiments.
Figure 5B:
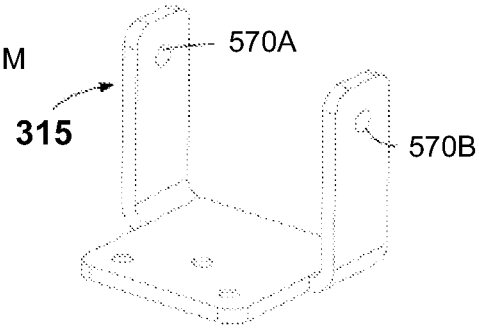
FIG. 5B illustrates an isometric view of a bracket adapted to mount an electrical contact assembly to a circuit breaker housing according to embodiments.
Figure 9:
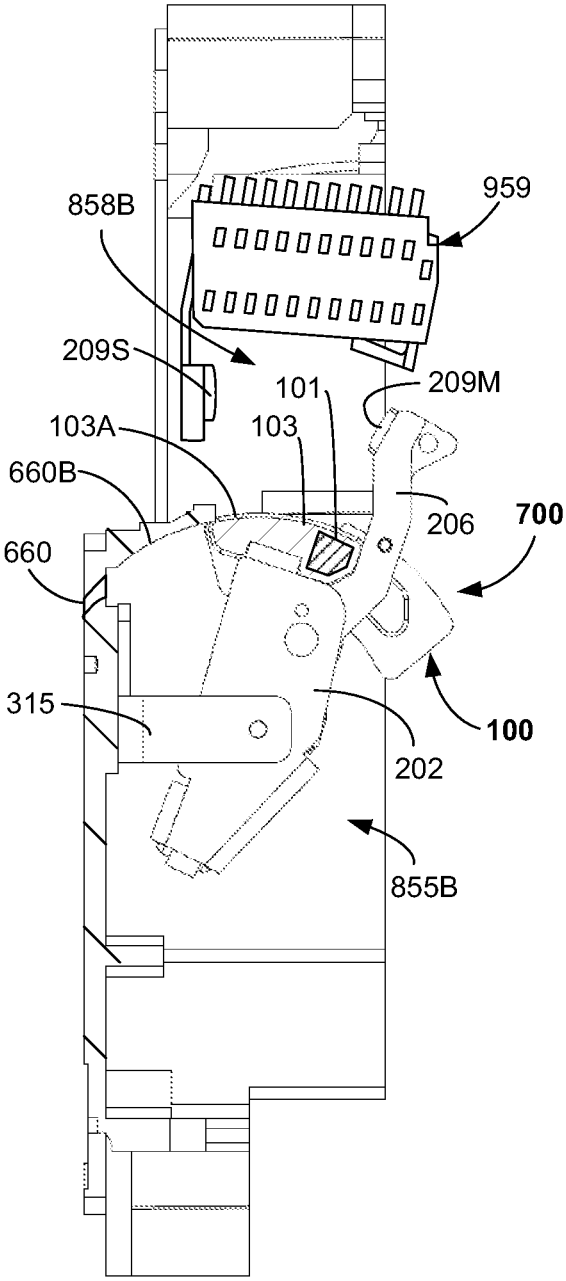
FIG. 9 illustrates a partially cross-sectioned side view of a circuit breaker housing including a multi-pole electrical contact assembly mounted therein according to embodiments.
Figure 10:
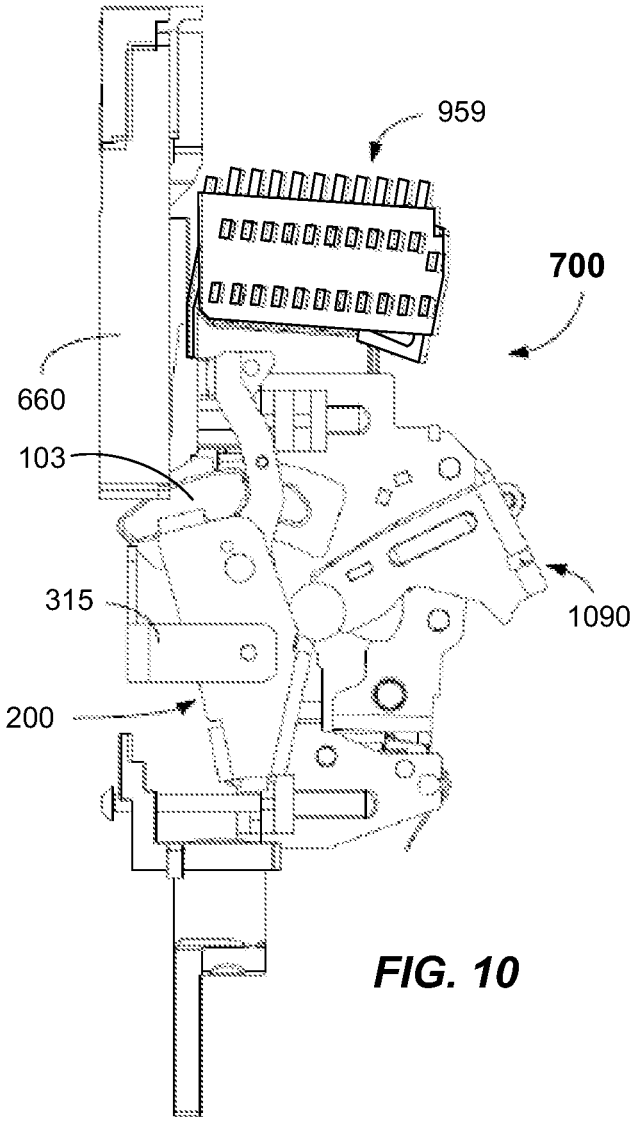
FIG. 10 illustrates a partially cross-sectioned side view of a circuit breaker including a multi-pole electrical contact assembly mounted therein according to embodiments.

Referring to FIGS. 2 and 4A-4B, the electrical contact assembly 200 may include a body structure such as a crossbar 202, a pivot pin 204 mounted in the crossbar 202, and one or more contact arms 206 pivotally mounted on the pivot pin 204 and rotatable about a first pivot axis 207 extending along a length of the pivot pin 204. The pivot pin 204 may be manufactured from a rigid material, such as steel. Other rigid materials may be used. In some embodiments, the pivot pin 204 may be a rivet. In the depicted embodiment, pivotal attachment of the contact assembly 200 to a circuit breaker housing 660 of a circuit breaker 700, as shown in FIGS. 9 and 10, may be about a second pivot axis 208. The crossbar 202 may function as a body to enable the pivotal attachment of the contact assembly 200 relative to a circuit breaker housing 660, such as shown in FIGS. 6A-6D, and FIGS. 9 and 10. Pivoting rotation of the contact assembly 200 about the second pivot axis 208 may be provided by pilots 213 extending laterally from either side of the crossbar 202 and rotationally received within holes 570A, 570B in a bracket 315 (FIGS. 3 and 5B).

The crossbar 202 may be manufactured from a suitably rigid material, such as a filled plastic or a metal (e.g., steel) sheet, and may include generally parallel first and second sidewalls 202A, 202B and a pocket 202C. In the depicted embodiment, the pivot, pin 204 may extend between the first and second sidewalls 202A, 202B. Furthermore, in the depicted embodiment, the multiple contact arms 206 are pivotally mounted on the pin 204 in a side-by-side orientation wherein the pin 204 passes through apertures 215. Suitable spacers (e.g., bosses on each arm 206) may maintain a proper spacing between the respective contact arms 206 such that they may rotate freely thereon. Mounted on each of the contact arms 206, such as on a first arm portion thereof, is a moveable electrical contact 209M. The moveable electrical contact 209M is spaced from the first pivot axis 207 on the first arm portion by a first distance. The first distance may be between about 40 mm and 60 mm, and about 54 mm in some embodiments, for example. Other first distances may be used.

Pivotally coupled to a second arm portion of each contact arm 206, is a spring assembly 210. The spring assembly 210 pivotally connects to the second arm portion by a pivoting connector at a connection location that is spaced a second distance from the first pivot axis 207. The second distance may be between about 15 and 25 mm, and about 19 mm in some embodiments, for example. Other distances may be used. Generally, the second distance is less than the first distance. Furthermore, the second arm portion of the contact arm 206 may be located on an opposite side of the pivot axis 207 from the first arm portion of the contact arm 206.

In some embodiments, the spring assembly 210 may comprise a strut. The spring assembly 210 is coupled between the crossbar 202 and the second arm portion of the contact arm 206. The spring assembly 210 may include, as shown in FIGS. 4A-4B, a clevis pin 212, and a spring 214 received on the clevis pin 212. The clevis pin 212 may be a cylindrical pin including an end portion 212A that is configured and adapted to be received and pivot relative to the crossbar 202.

In some embodiments, the crossbar 202 may include a crossbar insert 216 (FIGS. 4A-4B, 5A and 6D). In the depicted embodiment, each of the spring assemblies 210 couples to the crossbar 202 via the crossbar insert 216. Crossbar insert 216 may be received in the pocket 202C of the crossbar 202 or otherwise retained for rotation therein. In some embodiments, the crossbar 216 may be fastened by screws in the pocket 202C. The crossbar insert 216 may be a cast metal, such as steel, for example. A representative crossbar insert 216 is shown in cross section in FIGS. 4A-4B. Another crossbar insert is shown in FIG. 5A. The crossbar insert 216 is adapted to receive the ends 212A of the clevis pins 212 of spring assemblies 210. As should be understood, electrical contact assemblies 200 having any number of spring assemblies therein, such as one, two, three, four, five, or more may be provided. Each respective spring assembly 210 engages the crossbar insert 216.

Specifically, each clevis pin 212 may be received in a pivot recess 218 formed in the crossbar insert 216, for example. The pivot recess 218 may be oversized (e.g., larger in dimension) as compared to an outside dimension of the clevis pin 212 at the end 212A. For example, the clevis pin 212 may include a diameter of the cylindrical portion of between about 3 mm and 8 mm, or even about 3 mm and 5 mm, and may be about 4 mm in some embodiments. Other diameters may be used. In some embodiments, the pivot recess 218 may be elongated in one direction, such as along a direction of pivot of the clevis pin 212 in the crossbar insert 216. The elongation provides a larger dimension than the end of the clevis pin 212 along the direction of pivoting, as compared to the dimension perpendicular thereto, which may be only slightly larger than the end 212A of the clevis pin 212. The pivoting results from tripping of the contact assembly 200 from a closed (ON) configuration (FIG. 6A) to an open (OFF) configuration (see FIG. 6B).

Figure 6C:
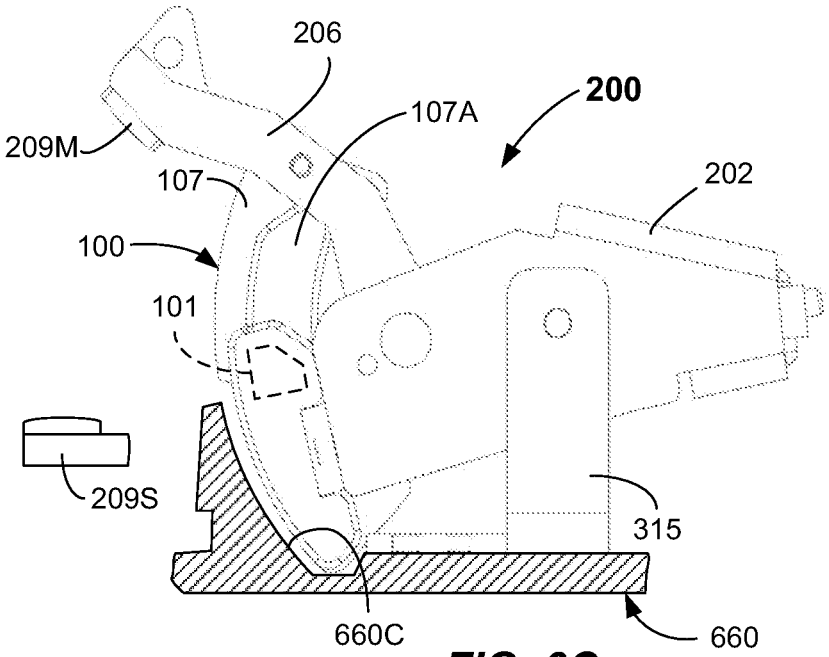
FIG. 6C illustrates a partially cross-sectioned side view of an electrical contact assembly shown in a blown open configuration according to embodiments.
Figure 6D:
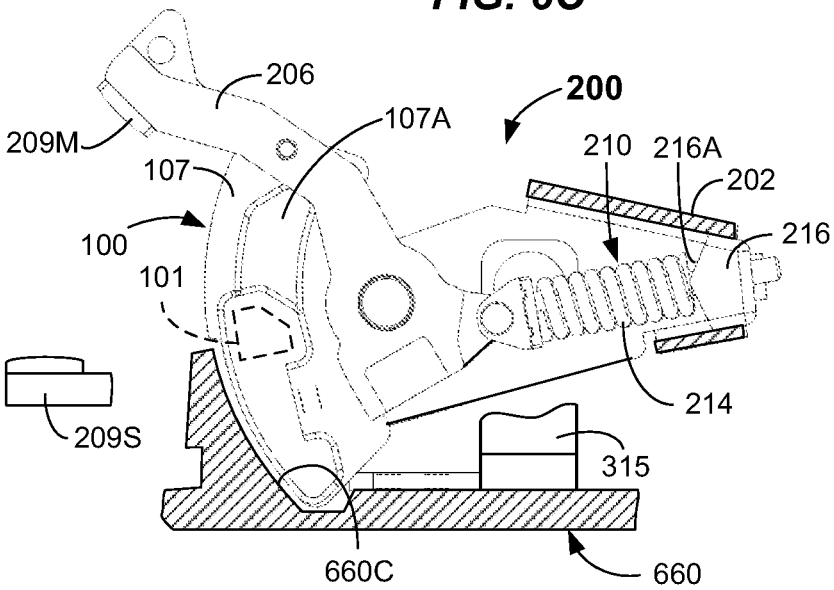
FIG. 6D illustrates a partially cross-sectioned side view of an electrical contact assembly shown in a blown open configuration illustrating an internal construction according to embodiments.

To minimize restriction (e.g., friction) due to pivoting resistance of the spring assembly 210 relative to the crossbar insert 216 as the spring assembly 210 pivots from the closed (FIG. 6A) to the open configuration (FIG. 6B), a curved or pointed surface 216A may be included on a portion of the crossbar insert 216 contacted by the spring 214 (See FIG. 6D). The surface of the crossbar insert 216 may also include lubrication or other low friction surface treatment thereon. In some embodiments, the structure of the crossbar insert 216 may be integral with the crossbar 202. In the case of a pointed ridge, the ridge may extend along the transverse width of the crossbar insert 216. The pointed ridge may be formed by the intersection of two planes formed on upper and lower sides of the front surface of the crossbar insert 216. A small radius may be provided on the ridge.

As best shown in FIGS. 4A-4B, the spring assembly 210 may include a spring retainer 219 in contact with a first end of the spring 214. The spring retainer 219 may be a separate component or part of the pivoting connector of the spring assembly 210, such as part of a clevis 220 (FIG. 4B) or rod end 228 (FIG. 4A). In the depicted embodiment, the spring 214 may be a helical coil spring. The spring 214 may have a spring constant (K) of between about 8 and 75 N/mm, for example. The spring 214 may have a length between about 30 mm and 50 mm, for example. The outer diameter of the helical coil spring 214 may be between about 6 mm and 14 mm, for example. The wire diameter of the spring 214 may be between about 1 mm and 3 mm. Other spring stiffnesses, lengths, outer diameters, and wire diameters may be used.

Other types of springs 214 may be used and received over the clevis pin 112, such as conical springs, bellville washers, volute spring, wave springs, dome springs, or the like. Table 1 below outlines various coil springs that may be used for several designs. However, in some embodiments different spring constants may be used. As will be described below, certain attachments of the rod end 228 to the second arm portion of the contact arm 206 may allow for use of slightly larger spring diameters. In some embodiments, use of larger springs may improve the withstand rating (maximum short time current the circuit breaker can withstand without opening the contacts) of the circuit breaker 700.

TABLE 1

Spring Examples

| | # Of Contact Arms | | |
|---|---|---|---|
| | 2 | 3 | 4 |
| Contact Force (N) | 68 | 44 | 33 |
| Spring Force (N) | 263.5 | 170.5 | 129.4 |
| Coil OD (mm) | 12.2 | 10 | 7.25 |
| Wire Diameter (mm) | 2.2 | 1.8 | 1.4 |
| Free Spring Length (mm) | 39.2 | 39.5 | 39.8 |

In some embodiments, as is shown in FIG. 4B, a first end of the spring assembly 210 may include a pivoting connector comprising a clevis 220 that is pivotally coupled to a terminal end of a second arm portion of the contact arm 206. The pivoting connection may be accomplished by passing a cross pin 222 through apertures formed in each side of the clevis 220 and through a hole formed at the terminal end of the second end portion of the contact arm 206. The cross pin 222 may be of any suitable configuration. For example, in some embodiments, the cross pin 222 may be a steel rivet. Cross pin 222 may be suitably press fit into clevis 220. In some embodiments, the cross pin 220 may include a head. In embodiments, a low friction pivot connection is formed at the first end by the pin 222 received in the pivoting connector and in the hole formed in the contact arm 206. Other pivoting connections may be used.

In the depicted embodiment of FIG. 4B, the spring retainer 219 comprises the portion of the clevis 220 that connects the respective sides of the clevis 220. The dimension of the spring retainer 219 in each embodiment should be sufficient to allow the spring 214 to be suitably compressed between crossbar insert 216 and the spring retainer 219 upon installation. In some embodiments, a contact surface area of the spring retainer 219 in contact with the spring 214 may be at least as large as the end of the spring 214. The spring retainer 219 may comprise a planar surface contacting the first end of the spring 214. The diameter of the clevis pin 212 should be sufficient to minimize any buckling of the spring 214 in the as-compressed condition. As installed, the spring 214 may be pre-compressed between the surface of the spring retainer 219 and the crossbar insert 216 sufficiently to provide a contact force between the stationary contact 209S and the moving contact 209M of between about 25 N and 120 N, for example. Other contact forces may be used.

In an alternate embodiment, the spring assembly 210 may include a pivoting connector comprising a rod end 228 pivotally coupled to a terminal end of a second arm portion of the contact arm 206 with a cross pin 222 as is shown in FIG. 4A. The rod end 228 may be coupled directly to the spring retainer 219. In some embodiments, the rod end 228 can be integral with the spring retainer 219. Rod end 228 includes a rigid hoop of material surrounding a hole that receives the cross pin 222. However, the spring retainer 219 and rod end 228 may be separate components in some embodiments.

To reduce an overall width of the contact assembly 200, combinations of spring assemblies 210 having pivoting connectors of one or more rod ends 228 and one or more clevises 220 may be provided. For example, the outer two spring assemblies 210 may include pivoting connectors that are rod ends 228, whereas the center spring assembly may include a pivoting connector that is a clevis 220. Any combination of rod ends 228 and clevises 220 may be utilized.

In the depicted embodiment of FIG. 5A, each of the spring assemblies 210 includes rod ends 228 that are laterally offset from a centerline of the clevis pin 212. Each rod end 228 includes an offset configuration wherein the hoop of the rod end 228 is offset laterally from an axial centerline of the clevis pin 212. This allows the spring assembly 210 to be mounted to the contact arms 206 in a number of different configurations. Such lateral offsets may allow for larger springs 214 to be used, while keeping the spacing between the contact arms 206 small. Larger springs can provide greater contact forces. Cross pins 222 are inserted through the offset rod ends 228 and may be peened for retention. The springs 214 may be pre-compressed between the crossbar insert 216 and the integral spring retainers 219. Arc horns 240 may be provided on the ends of the contact arms 206 opposite the moveable contacts 209M.

Again referring to FIGS. 1-3, individual contact assemblies 200 may be assembled into a multi-pole contact assembly 300. In the depicted embodiment, the contact assemblies 200 are identical to one another, and each one is adapted to receive a single electrical phase provided from a polyphase electrical power distribution system (not shown). A three-phase contact assembly 300 is shown, but various embodiments are equally adapted for use with four-phase systems, five-phase systems, or the like. Each of the individual contact assemblies 200 may be pivotally mounted to the circuit breaker housing 660 (FIG. 6A-6D) by the bracket 315 (FIG. 3), as is described further herein. The limit stop apparatus 100 may be provided underneath the contact arms 206 and include limit stops 102, 103, 104 engageable with the one or more contact arms 206 of each contact assembly 200 (FIGS. 3, 6A-6D, and 8-10).

In operation, the limit stop apparatus 100 includes limits stops 102, 103, 104 that are engageable with the contact arms 206 on a same side of the contact arms 206 containing the moveable contact 209M between the first pivot axis 207 and the moveable contacts 209M. Providing the limit stop apparatus 100 including limit stops 102, 103, 104 under the contact arm 206 may allow for a lower overall profile height of the contact assembly 300. The limit stop apparatus 100 may limit a motion of the spring assemblies 210 and rotation of contact arms 206. For example, the limit stop apparatus can allow all electrical phases to be opened or closed simultaneously by operating the handle 725 of the circuit breaker 700 (FIG. 7). At other times, the limits stops 102, 103, 104 rest against the contact arms 206 and prevent the contact arms 206 from pivoting beyond an intended range. For example, the limit stop apparatus 100 may be rotated into the OFF position a short delay time after a tripping event, by a tripping device. The pivot stop apparatus 100 may prevent the contact arms 206 from over rotation due to contact erosion due to mechanical wear or fatigue, for example. Additionally or alternatively, the limit stop apparatus 100 may include features that function as a barrier wall or shield to minimize arcing between adjacent phases from the separation of the electrical contacts 209M, 209S of each phase, but also to minimize an extent of spray of arcing debris onto contact, assembly components or between the phases.

As best shown in FIG. 9, the limit stop apparatus 100 is attached to a front, end of the crossbar 202 facing the stationary and moveable electrical contacts 209S, 209M and functions as a shield that prevents arcing debris from separation of the electrical contacts 209S, 209M from each phase from entering into respective separated areas 855A, 855B, 855C of the circuit breaker housing 760 from each of the respective arc chambers 858A, 858B, and 858C.

Figure 1C:
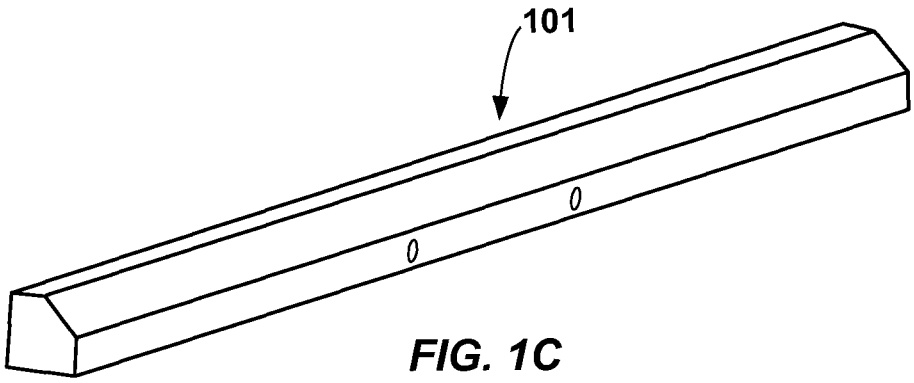
FIG. 1C illustrates a front isometric view of a connecting bar of a limit stop apparatus according to embodiments.
Figure 1D:
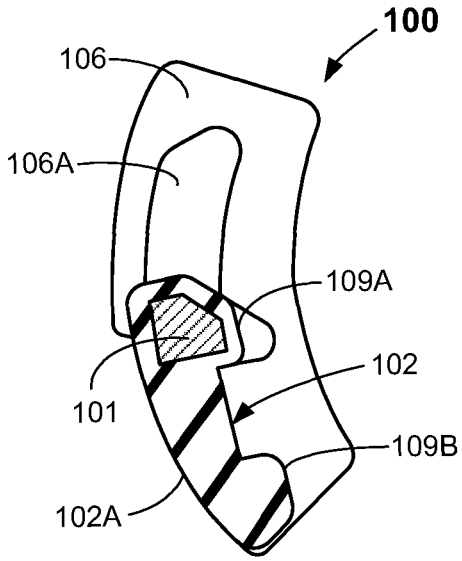
FIG. 1D illustrates a cross-sectioned side view of the limit stop apparatus taken along section line 1D-1D of FIG. 1B according to embodiments.

As best depicted in FIGS. 1C and 1D the limit stop apparatus 100 may include a reinforcing connecting bar 101, which may be manufactured from a nonferrous material. Suitably rigid nonferrous materials comprise a reinforcing steel rod such as a stainless steel rod. Other suitably rigid, electrically-nonconductive materials may be used, such as filled plastics. The connecting bar 101 may be about 7 mm tall×7 mm wide×180 mm long and may extend across a lateral width of the circuit breaker housing 660. In some embodiments, the connecting bar 101 may include a chamfer along an entire length of one or more edges, for example. Other sizes and shapes may be used.

In the depicted embodiment, the remaining portion of the limit stop apparatus 100 (that is not the connecting bar 101) and the limit stops may be manufactured from a moldable material. Thus, a limit stop apparatus 100 including integrated limit stops 102, 103, 104 and arc shields may be formed. Suitable molded materials comprise plastic (e.g., a thermoplastic), such as the plastic used, for the circuit breaker housing 660, rubber, or the like. A suitable material is fiberglass-filled polyester. The connecting bar 101 (e.g., reinforcing steel rod) may be received through all of the limit stops 102, 103, 104 and connector portions 105, and in some embodiments may be bonded thereto. A skin of molded material should cover all portions of the connecting bar 101. The skin thickness may be greater than about 1 mm. In some embodiments, the skin thickness may be between about 1 mm to about 5 mm, or even between about 1.5 mm to about 3 mm.

The limit stop apparatus 100 may include one or more arc shields. The one or more arc shields may be molded, such as by an injection molding process. For example, in the depicted embodiment, the arc shields may comprise contact-to-components arc shields 102A, 103A, 104A embodied in the limit stops 102, 103, 104 that are spaced laterally from one another and may be molded to, interconnected, and/or structurally reinforced (e.g., stiffened) by the connecting bar 101. The contact-to-components arc shields 102A, 103A, 104A may be provided with a curved frontal surface on each of the limit stops 102, 103, 104 facing the moveable contacts 209M. The curved surfaces may closely mesh with a similar curved surface (e.g., curved surfaces 660B, 660C) formed on the circuit breaker housing 660 (FIGS. 6A-6D) for each phase. For example, a small gap (e.g., approx. 0.5 mm) may be provided between the curved frontal surface of contact-to-components arc shield 104A and the curved surface 660C. Similar gaps may be provided between arc shield 103A and the curved surface 660B and between the arc shield 102A and the curved surface on the circuit, breaker housing 660 for the first phase. Other sized gaps may be used.

Again referring to FIG. 1A-1B, each of the limit stops 102, 103, 104 may include upper projections 109A and lower projections 109B extending from a side of each limit stop 102, 103, 104 facing the tabs 232. The projections 109A, 109B may function to allow ease of assembly by registering on the tabs 232.

In an ON configuration (see FIG. 6A) the curved frontal surface of the contact-to-components arc shield 104A of the limit stop 104 is received proximate to a surface (e.g., curved surface 660C) of the circuit breaker housing 660 (only a portion shown). Upon tripping or opening, the curved frontal surface of the contact-to-components arc shield 104A moves (e.g., rotates) relative to the stationary surface 660C of the circuit breaker housing 660. The contact-to-components arc shield 104A and the curved surface 660C may still slightly overlap at the maximum rotational excursion of the crossbar 202. The contact-to-components arc shields 102A, 103A, 104A effectively form a barrier wall or shield for each electrical phase that may operatively minimize arc debris from exiting each respective arc chamber 858A-858C (FIG. 8) of the circuit breaker housing 660. In particular, the cooperation of the curved surfaces 660A, 660B, 660C of the circuit breaker housing 660 and the contact-to-components arc shields 102A, 103A, 104A are particular effective at limiting arc spatter.

Referring to FIGS. 8 and 9, each of the arc chambers 858A-858C may include the stationary electrical contact 209S, and an arc plate assembly 959 (FIG. 9). Arc plate assemblies are not shown in FIG. 8. Thus, splattering of debris may be minimized into a respective separated chamber 855A-855C containing the other contact assembly components of each of the contact assemblies 200 (e.g., pivoting connectors, spring assemblies 210, brackets 500, or the like). Such arc debris, may over time impact the smooth tripping action of the circuit breaker 700. Minimization of the travel of such arcing debris splatter is desired. Thus, the contact-to-components arc shields 102A, 103A, 104A of the limit stops 102, 103, 104 function to block splattering of arc debris generated by the separation of the moving and stationary electrical contacts 209M, 209S from traveling from the respective arc chambers 858A-858C to the respective separated chambers 855A-855C where the various contact assembly components reside.

Again referring to FIGS. 1A-1B, the limit stop apparatus 100 may also include, for example, formed as a molded projection, an interlock interface 110. The interlock interface 110 may extend from the back side of the limit stop apparatus 100 and function to interface with a plunger to allow interlock of two adjacent circuit breakers.

Referring to FIGS. 1A-1B, 1D, FIGS. 6A-6D, and FIG. 8, the arc shields may comprise phase-to-phase arc shields 106, 107 that are spaced laterally along a length of the limit stop apparatus 100 and integral with the limit stops 102, 103, 104 of the limit stop apparatus 100. The phase-to-phase arc shields 106, 107 may include planar surfaces 106A, 107A that interface with openings in walls 865A, 665B of the circuit breaker housing 660 (FIG. 8) that separate the respective electrical phases. In the depicted embodiment, the phase-to-phase arc shields 106, 107 are shown molded to the connecting bar 101 on an inner end of the outermost limit stops 102, 104. However, additionally, or alternatively, they may be molded on the ends of the center limit stop 103. Each of the phase-to-phase arc shields 106, 107 may include stiffening portions 106A, 107A that are adapted to reinforce and limit lateral flexing of the phase-to-phase arc shields 106, 107. Stiffening portions 106A, 107A may be rib areas of the molding that are thicker.

Each of the phase-to-phase arc shields 106, 107 may be shaped and sized so that the openings in the walls 865A, 865B are covered regardless of the position of the limit stop apparatus 100. As installed, the connecting portions 105 are received in the openings of the walls 865A, 865B. Accordingly, the limit stop apparatus 100 in some embodiments provides a single component that interconnects the contact assemblies 200, and also includes integrated arc shields that shield rearward spray of arc debris towards the respective contact components, and also minimizes phase-to-phase arcing. The limit stop apparatus 100 is sufficiently rigid to transfer the load from operation of the handle 725 of the circuit breaker 700 connected to the handle assembly 1090 (FIG. 10) to simultaneously move each of the interconnected contact assemblies 200 such that all electrical phases may be simultaneously actuated.

In the depicted embodiment of FIG. 8, a first electrical phase and the components thereof is received and operable in arc chamber 858A and separated chamber 855A. A second electrical phase and the components thereof are received and operable in arc chamber 858B and separated chamber 855B. A third electrical phase and the components thereof are received and operable in arc chamber 858C and separated chamber 855C.

FIGS. 3 and 8 illustrates the limit stop apparatus 100 for a three-pole circuit breaker 700 wherein the three contact assemblies 200 (see FIG. 2) are coupled together by the limit stop apparatus 100. Thus, the crossbars 202 all rotate in unison. The limit stop apparatus 100 may be coupled to the respective crossbar 202 by mounting features. For example, fasteners 311 (e.g., screws, bolts, rivets or the like) may be received through holes 108 (FIG. 1A) and coupled (e.g., by threaded nuts) to tabs 232 formed on the sides of crossbars 202 (FIG. 2). Tabs 232 may include captured or welded nuts.

In operation, when a tripping event occurs, such as due to a current over the rated current of the phase, rotation of the moveable contact arms 206 occurs. This causes the contact arms 206 to rapidly rotate and move from a closed (ON) configuration (FIG. 6A) to a blown open configuration (FIGS. 6C and 6D). Initially (in the closed configuration), a force vector is oriented and directed from the crossbar insert 216 through the spring 214 and spring retainer 219 to the pivoting connection location of the spring assembly 210 to the second arm portion of contact arm 206. This force vector is provided on a first side of the pivot axis 207. Accordingly, action of the spring assembly 210 provides a spring force to maintain the moveable and stationary contacts 209S, 209M in intimate contact and under suitable contact pressure. Upon tripping, the force vector crosses over the pivot axis 207 as the contact arm 206 moves from a closed configuration to an open configuration (FIG. 6C). In the opened configuration, as shown in FIG. 6C, the force vector extends from the crossbar insert 216 through the spring 214 and spring retainer 219 and through the connection of the spring assembly 210 to the contact arm portion, and the force vector is now provided on the opposite side of the pivot axis 207. Accordingly, the spring force provided by the spring assembly 210 now holds the contact arms 206 in an open configuration. A short duration after a trip is experienced, an actuator (not shown) may rotate the assembly of crossbars 202 and limit stop apparatus 100 into a position as shown in FIG. 6B.

Resetting of the contact arms 206 to a closed configuration (e.g., FIG. 6A) may be provided by any suitable mechanical mechanism 1090 contacting the one or more contact arms 206 or crossbars 202 to cause the one or more arms 206 to move back to the closed configuration.

FIGS. 6A-10 illustrates a circuit breaker 700 including a circuit breaker housing 660 that receives a plurality of electrical contact assemblies 200 therein. As best shown in FIGS. 6A-6D, each of the contact assemblies 200 may be pivotally attached to the housing 660 by the bracket 315 (FIG. 5B). Bracket 315 includes holes 570A, 570B that are received over pilots 213. Pilots 213 allow the respective contact assemblies 200 to pivot relative to the bracket 315, and, thus, the breaker housing 660.

FIG. 10 illustrates some additional components of the circuit breaker 700, such as arc plate stack 959 and handle assembly 1090 adapted to reset the circuit breaker 700 after a tripping event to the "ON" configuration or otherwise turn the circuit breaker 700 to the "OFF" configuration.

Figure 11:
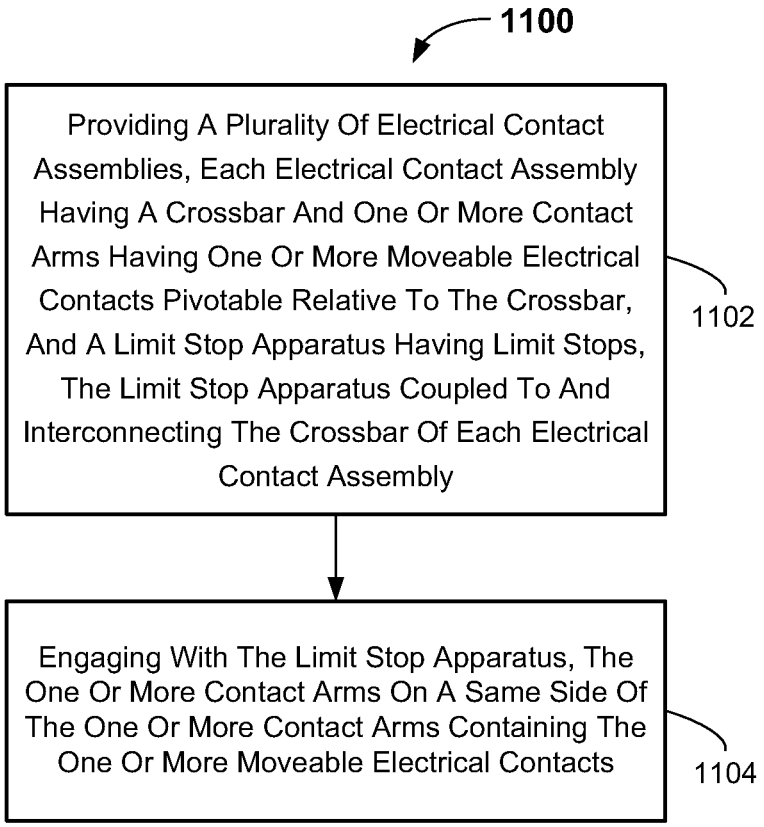
FIG. 11 is a flowchart illustrating a method of operating an electrical contact assembly according to embodiments.

FIG. 11 is a flowchart illustrating a method of operating a multi-pole electrical contact assembly (e.g., 300) according to embodiments. The method 1100 includes, in 1102, providing a plurality of electrical contact assemblies (e.g., contact assemblies 200), each electrical contact assembly having a crossbar (e.g., crossbar 202) and one or more contact arms (e.g., contact arms 206) having one or more moveable electrical contacts (e.g., moveable electrical contacts 209M) moveable relative to the crossbar, and a limit stop apparatus (e.g., limit stop apparatus 100) coupled to and interconnecting the crossbar of each electrical contact assembly. In 1104, the limit stop apparatus engages the one or more contact arms on a same side of the one or more contact arms containing the one or more moveable electrical contacts. In some embodiment, the limit stop apparatus 100 is positioned very close to the moveable contact 209M and engages the one or more contact arms between the moveable contacts 209M and the first pivot axis 207.

Figure 12:
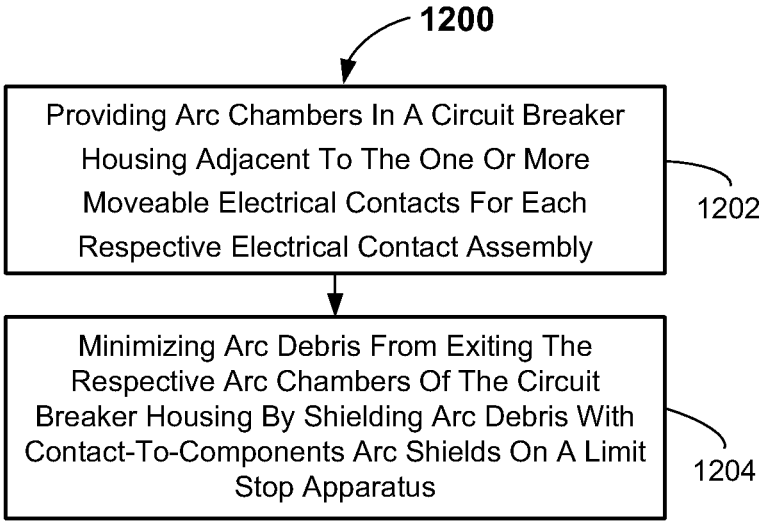
FIGS. 12-13 are flowcharts illustrating other methods of operating electrical contact assemblies according to embodiments.

According to alternative or additional embodiments as shown in FIG. 12, a method 1200 of operating a multi-pole electrical contact assembly (e.g., multi-pole electrical contact assembly 300) includes, in 1202, providing arc chambers (e.g., 858A-858C) in a circuit breaker housing (e.g., circuit breaker housing 660) adjacent to the one or more moveable electrical contacts (e.g., moveable electrical contacts 209M) for each respective electrical contact assembly (e.g., contact assemblies 200). The method 1200, in 1204, also includes minimizing arc debris from exiting the respective arc chambers of the circuit breaker housing by shielding arc debris with contact-to-component arc shields (102A, 102B, 102C) formed on the limit stop apparatus (e.g., limit stop apparatus 100). In particular, the contact-to-component arc shields 102A, 103A, 104A may be integral to and molded with the limit stops 102, 103, and 104.

Figure 13:
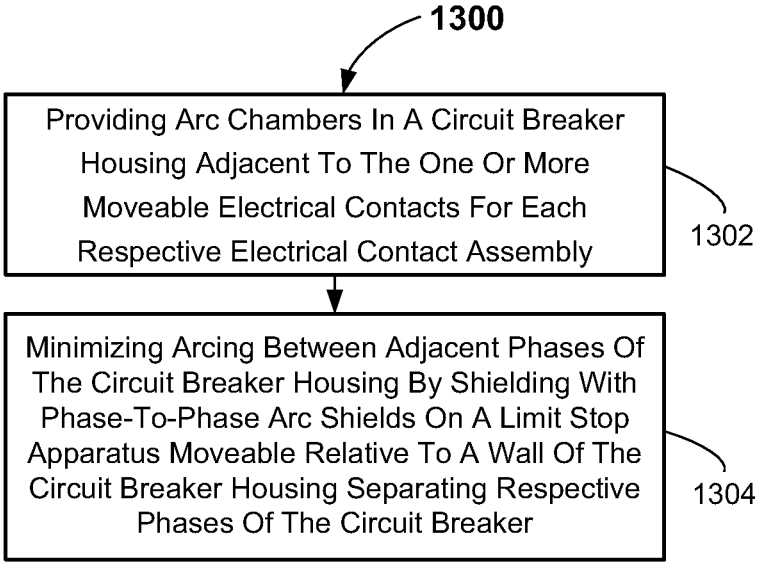

According to another alternative or additional embodiment as shown in FIG. 13, a method 1300 of operating a multi-pole electrical contact assembly (e.g., multi-pole electrical contact assembly 300) includes, in 1302, providing arc chambers (e.g., 858A-858C) in a circuit breaker housing (e.g., circuit breaker housing 660) adjacent to the one or more moveable electrical contacts (e.g., moveable electrical contacts 209M) for each respective electrical contact assembly (e.g., contact assemblies 200). The method 1300, in 1304, also includes minimizing arcing arc between adjacent phases of the circuit breaker housing by shielding with phase-to phase arc shields (e.g., phase-to-phase arc shields 106, 107) on the limit stop apparatus (e.g., limit stop apparatus 100) that are moveable relative to a wall (e.g., walls 865A, 865B) of the circuit breaker housing separating respective phases of the circuit breaker housing. The with phase-to phase arc shields (e.g., phase-to-phase arc shields 106, 107) may prevent arc debris from exiting one phase and traveling to an adjacent phase of the circuit breaker housing by shielding the arc debris with phase-to phase arc shields.

While the invention is susceptible to various modifications and alternative forms, specific embodiments and methods thereof have been shown by way of example in the drawings and are described in detail herein. It should be understood, however, that it is not intended to limit the invention to the particular apparatus, systems, or methods disclosed, but, to the contrary, the intention is to cover all modifications, equivalents and alternatives falling within the scope of the invention.

What is claimed is:

1. A limit stop apparatus, comprising:

a connecting bar;

a plurality of limit stops spaced along and integrated with the connecting bar, wherein each limit stop is configured to be engageable with one or more contact arms; and arc shields molded to the connecting bar, the arc shields comprising phase-to-phase arc shields and contact-to-component arc shields.

2. The limit stop apparatus of claim 1, wherein the connecting bar comprises a non-ferrous material.

3. The limit stop apparatus of claim 1, wherein the arc shields comprises fiberglass-filled polyester.

4. The limit stop apparatus of claim 1, comprising mounting features that are configured and adapted to couple to and interconnect crossbars of multiple electrical contact assemblies.

5. The limit stop apparatus of claim 1, wherein the contact-to-component arc shields, each have a curved frontal surface configured and adapted to interface with a surface of a circuit breaker housing to operatively minimize arc debris from exiting respective arc chambers.

6. A multi-pole electrical contact assembly, comprising:

a plurality of electrical contact assemblies, each electrical contact assembly having a crossbar and one or more contact arms pivotable relative to the crossbar; and a limit stop apparatus coupled to the crossbar of each electrical contact assembly, wherein the limit stop apparatus includes limit stops integrated with a connecting bar and configured and adapted to engage the one or more contact arms on a same side of the one or more contact arms containing moveable electrical contacts, wherein the limit stop apparatus is configured to limit motion of the one or more contact arms.

7. The multi-pole electrical contact assembly of claim 6, wherein the limit stop apparatus comprises one or more arc shields.

8. The multi-pole electrical contact assembly of claim 7, wherein the one or more arc shields comprises a contact-to-component arc shield for each of the electrical contact assemblies of the plurality of electrical contact assemblies.

9. The multi-pole electrical contact assembly of claim 7, wherein the one or more arc shields comprises a phase-to-phase arc shield for each of the electrical contact assemblies of the plurality of electrical contact assemblies.

10. The multi-pole electrical contact assembly of claim 6, wherein the limit stop apparatus comprises:

a connecting bar; and one or more arc shields molded to the connecting bar.

11. The multi-pole electrical contact assembly of claim 10, wherein the one or more arc shields comprises phase-to-phase arc shields and contact-to-component arc shields.

12. The multi-pole electrical contact assembly of claim 6, wherein the limit stop apparatus includes a contact-to-component arc shield for each of the electrical contact assemblies of the plurality of electrical contact assemblies, and each contact-to-component arc shield has a curved surface adapted to be received proximate a surface of a circuit breaker housing, the curved surface being moveable relative to the surface of the circuit breaker housing to operatively minimize arc debris from exiting an arc chamber of the circuit breaker housing.

13. The multi-pole electrical contact assembly of claim 6, wherein the limit stop apparatus is mounted to tabs formed on sides of each of the crossbars.

14. The multi-pole electrical contact assembly of claim 6, wherein the limit stop apparatus comprises:

a non-ferrous connecting bar; and phase-to-phase arc shields and contact-to-component arc shields molded to the non-ferrous connecting bar.

15. A circuit breaker, comprising:

a circuit breaker housing;

a plurality of electrical contact assemblies, each electrical contact assembly having a crossbar and one or more contact arms moveable relative to the crossbar; and a limit stop apparatus coupled to the crossbars of each of the plurality of electrical contact assemblies, wherein the limit stop apparatus includes limit stops integrated with a connecting bar and configured and adapted to engage the one or more contact arms on a same side of the one or more contact arms containing moveable electrical contacts, wherein the limit stop apparatus is configured to limit motion of the one or more contact arms.

16. The circuit breaker of claim 15, wherein the limit stop apparatus comprises:

contact-to-component arc shields moveable relative to a surface of the circuit breaker housing to operatively minimize arc debris from exiting respective arc chambers of the circuit breaker housing; and phase-to-phase arc shields moveable relative to a phase separating wall separating respective phases of the circuit breaker to operatively minimize arc debris from exiting a respective arc chamber and entering an adjacent phase.

17. The circuit breaker of claim 15, wherein the limit stop apparatus comprises:

a non-ferrous connecting bar;

contact-to-component arc shields molded to the non-ferrous connecting bar and moveable relative to a surface of the circuit breaker housing to operatively minimize arc debris from exiting respective arc chambers of the circuit breaker housing; and phase-to-phase arc shields molded to the non-ferrous connecting bar and moveable relative to a phase separating wall separating respective phases of the circuit breaker to operatively minimize arc debris from exiting a respective arc chamber and entering an adjacent phase.

18. A method of operating a multi-pole electrical contact assembly, comprising:

providing a plurality of electrical contact assemblies, each electrical contact assembly having a crossbar and one or more contact arms having one or more moveable electrical contacts pivotable relative to the crossbar, and a limit stop apparatus having limit stops integrated with a connecting bar, the limit stop apparatus coupled to and interconnecting to the crossbar of each electrical contact assembly; and engaging with the limit stop apparatus, the one or more contact arms on a same side of the one or more contact arms containing the one or more moveable electrical contacts to limit motion of the one or more contact arms.

19. The method of claim 18, comprising:

providing arc chambers in a circuit breaker housing adjacent to the one or more moveable electrical contacts for each respective electrical contact assembly; and minimizing arc debris from exiting the respective arc chambers of the circuit breaker housing by shielding arc debris with contact-to-component arc shields on the limit stop apparatus.

20. The method of claim 18, comprising:

providing arc chambers in a circuit breaker housing adjacent to the one or more moveable electrical contacts for each respective electrical contact assembly; and minimizing arcing between adjacent phases of the circuit breaker housing by shielding with phase-to-phase arc shields on the limit stop apparatus moveable relative to a wall of the circuit breaker housing separating respective phases of the circuit breaker.

* * * * *